US007963462B1

(12) United States Patent
Ramos, Sr.

(10) Patent No.: US 7,963,462 B1
(45) Date of Patent: Jun. 21, 2011

(54) RECREATIONAL VEHICLE TOILET TANK CLEANING ASSEMBLY

(76) Inventor: John C. Ramos, Sr., Santa Maria, CA (US)

( * ) Notice: Subject to any disclaimer, the term of this patent is extended or adjusted under 35 U.S.C. 154(b) by 329 days.

(21) Appl. No.: 12/142,041

(22) Filed: Jun. 19, 2008

(51) Int. Cl.
*B05B 3/02* (2006.01)

(52) U.S. Cl. ..... 239/222.15; 239/233; 239/237; 239/251; 239/281; 239/556; 239/559; 134/167 C; 134/167 R

(58) Field of Classification Search ..... 239/280, 239/281, 233, 240, 251, 237, 222.15, 556, 239/559; 134/104.1, 167 C, 169 R
See application file for complete search history.

(56) References Cited

U.S. PATENT DOCUMENTS

| | | | | | |
|---|---|---|---|---|---|
| 2,930,531 | A | * | 3/1960 | Kennedy, Jr. | 239/229 |
| 4,030,513 | A | | 6/1977 | McKenzie | |
| 4,182,497 | A | | 1/1980 | Ferreira | |
| 4,487,368 | A | * | 12/1984 | Clearman | 239/229 |
| 4,600,153 | A | | 7/1986 | Stone | |
| D317,967 | S | | 7/1991 | Pelletier | |
| 5,253,716 | A | * | 10/1993 | Mitchell | 169/70 |
| 5,381,964 | A | | 1/1995 | Reyna | |
| 5,573,187 | A | * | 11/1996 | Proctor | 239/532 |
| 5,884,842 | A | * | 3/1999 | Caine et al. | 239/251 |
| 5,964,419 | A | | 10/1999 | Lovett | |
| 6,378,791 | B1 | | 4/2002 | Perry et al. | |
| 6,398,136 | B1 | | 6/2002 | Smith | |
| 2002/0174886 | A1 | * | 11/2002 | Paper et al. | 134/169 R |

* cited by examiner

*Primary Examiner* — Dinh Q Nguyen

(57) ABSTRACT

A recreational vehicle toilet tank cleaning assembly includes a tube that has a terminal end. A nozzle is removably coupled to the terminal end. The nozzle has a first end, a second end and a perimeter wall extending between the first and second ends. The first end is open and is threadably coupled to the terminal end of the tube. The nozzle has a plurality of apertures therein. The apertures include a primary aperture extending through the second end that is aligned with a longitudinal axis of the nozzle. The perimeter wall has a break therein and the nozzle includes a first portion rotatably coupled to a second portion. The second portion includes the plurality of apertures. The tube is fluidly couplable to a water source and the nozzle placed in a recreational vehicle toilet tank to eject water outwardly of the plurality of apertures and clean the tank.

11 Claims, 6 Drawing Sheets

10
46
44
12
5
30
32
28
5

46
44
16
18
16
14
22
26
24
20
28

RECREATIONAL VEHICLE TOILET TANK CLEANING ASSEMBLY

BACKGROUND OF THE INVENTION

1. Field of the Invention

The present invention relates to tank cleaning devices and more particularly pertains to a new tank cleaning device allowing a person to quickly and proficiently clean the toilet receptacle system of a recreational vehicle.

2. Summary of the Invention

The present invention meets the needs presented above by generally comprising a tube that has a terminal end. A nozzle is removably coupled to the terminal end. The nozzle has a first end, a second end and a perimeter wall extending between the first and second ends. The first end is open and is threadably coupled to the terminal end of the tube. The nozzle has a plurality of apertures therein. The apertures include a primary aperture extending through the second end that is aligned with a longitudinal axis of the nozzle. The perimeter wall has a break therein and the nozzle includes a first portion rotatably coupled to a second portion. The second portion includes the plurality of apertures. The tube is fluidly couplable to a water source and the nozzle placed in a recreational vehicle toilet receiving tank to eject water outwardly of the plurality of apertures and clean the tank.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
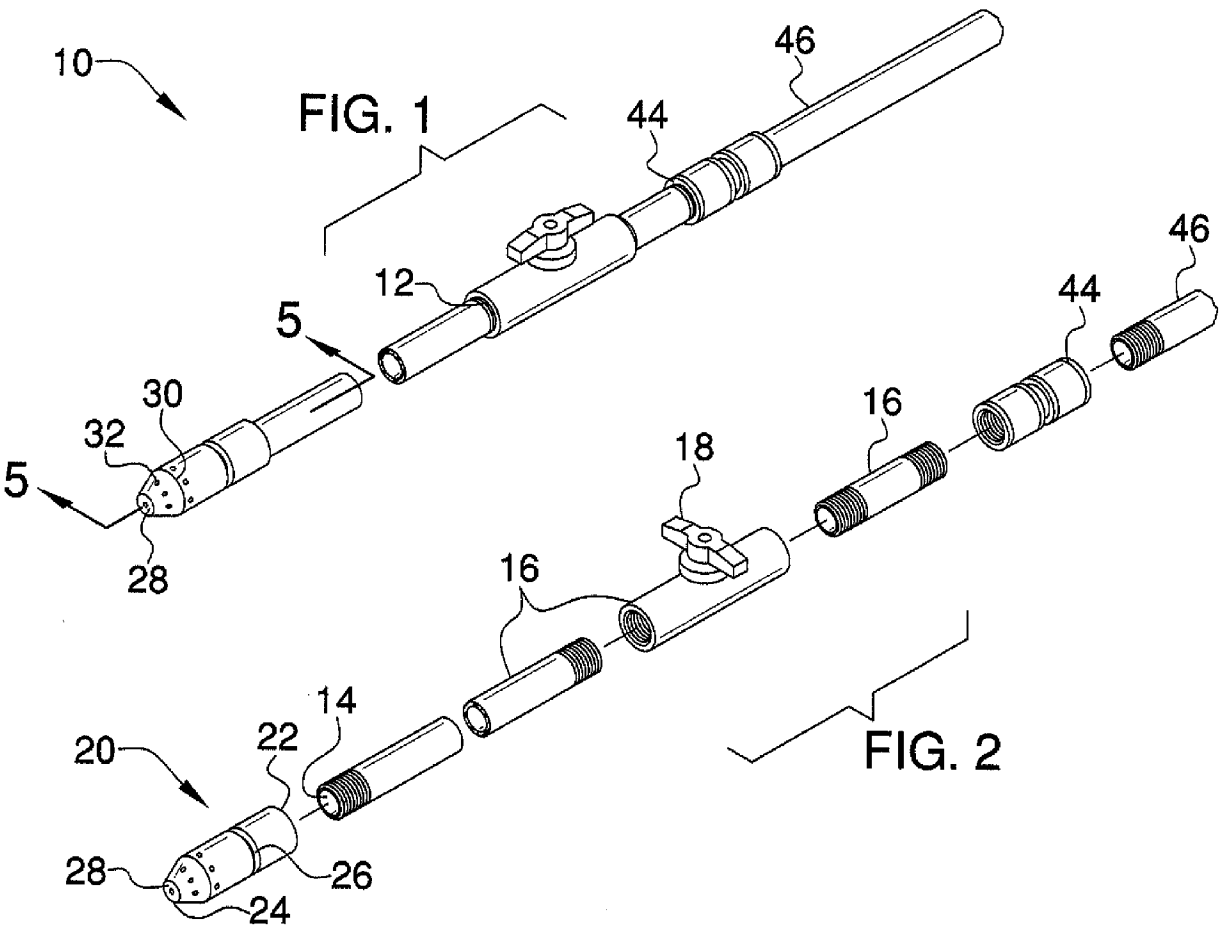
FIG. 1 is a broken perspective view of a recreational vehicle toilet tank cleaning assembly according to the present invention.
FIG. 2 is an expanded and broken perspective view of the present invention.
Figure 3:
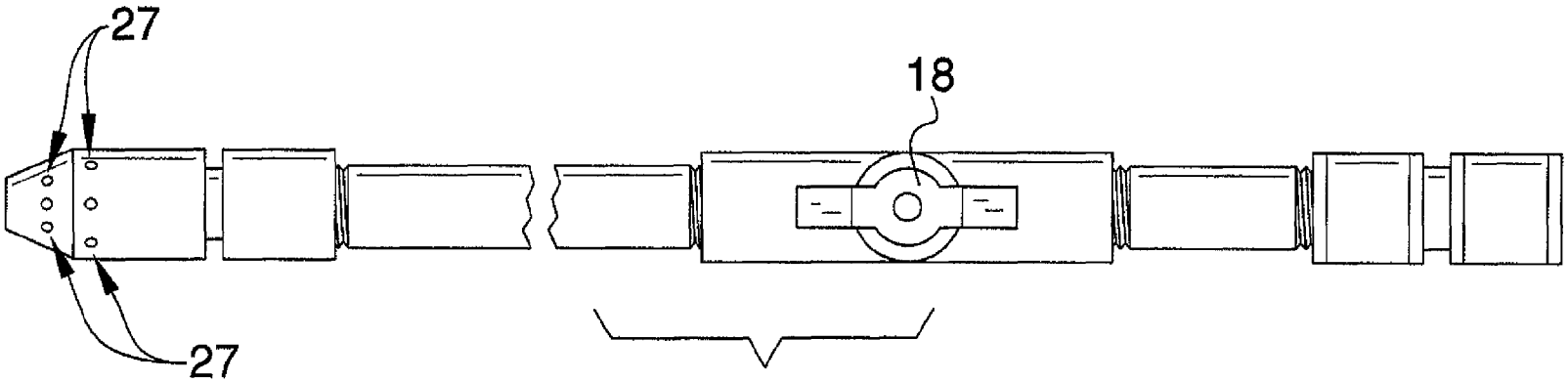
FIG. 3 is a top broken view of the present invention.
Figure 4:
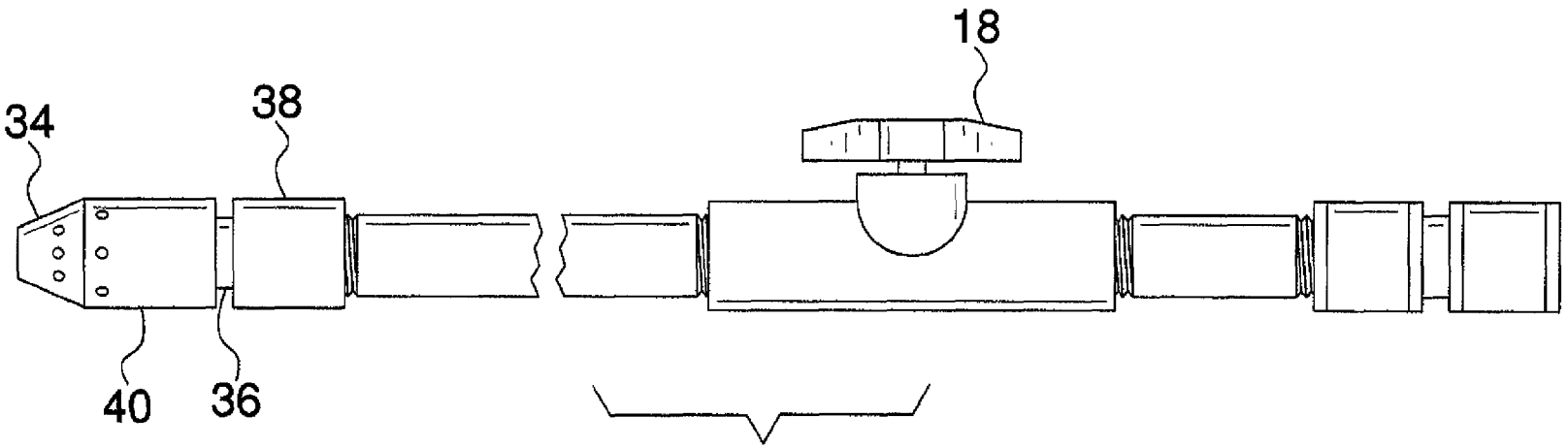
FIG. 4 is a side broken view of the present invention.
Figure 5:
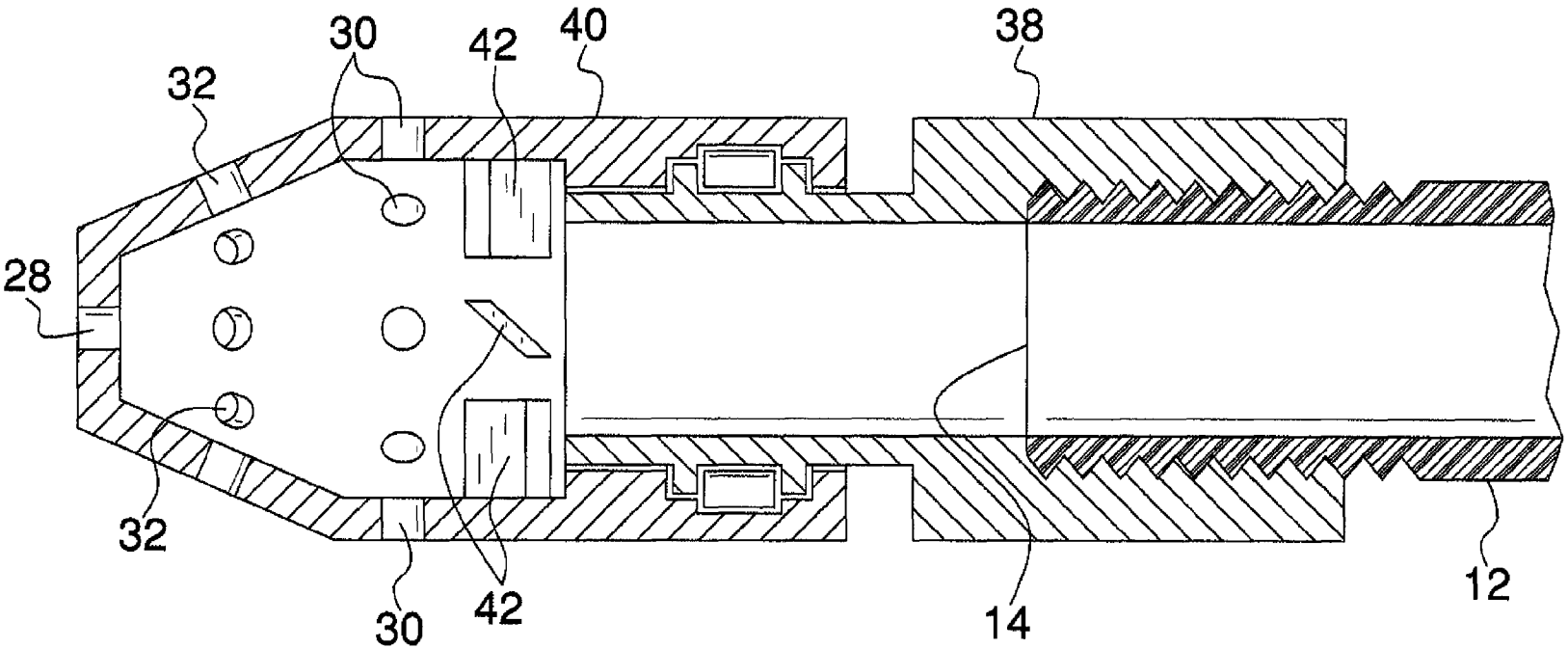
FIG. 5 is a cross-sectional view taken along line 5-5 of FIG. 1 of the present invention.
Figure 6:
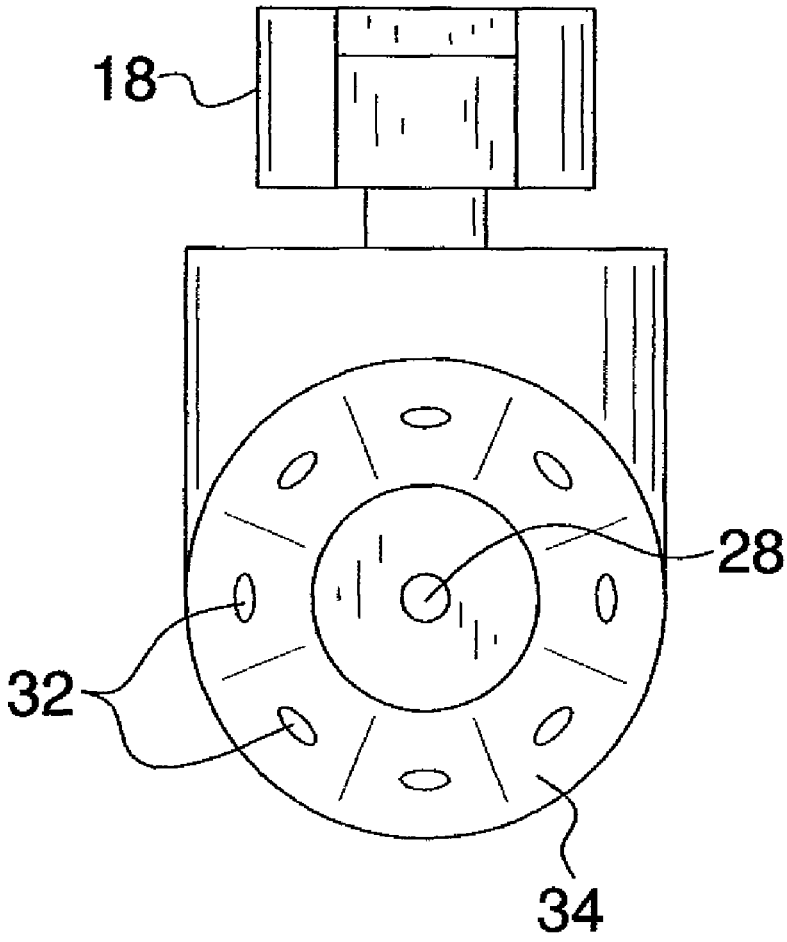
FIG. 6 is a front view of the present invention.

With reference now to the drawings, and in particular to FIGS. 1 through 8 thereof, a new tank cleaning device embodying the principles and concepts of the present invention and generally designated by the reference numeral 10 will be described.

Figure 7:
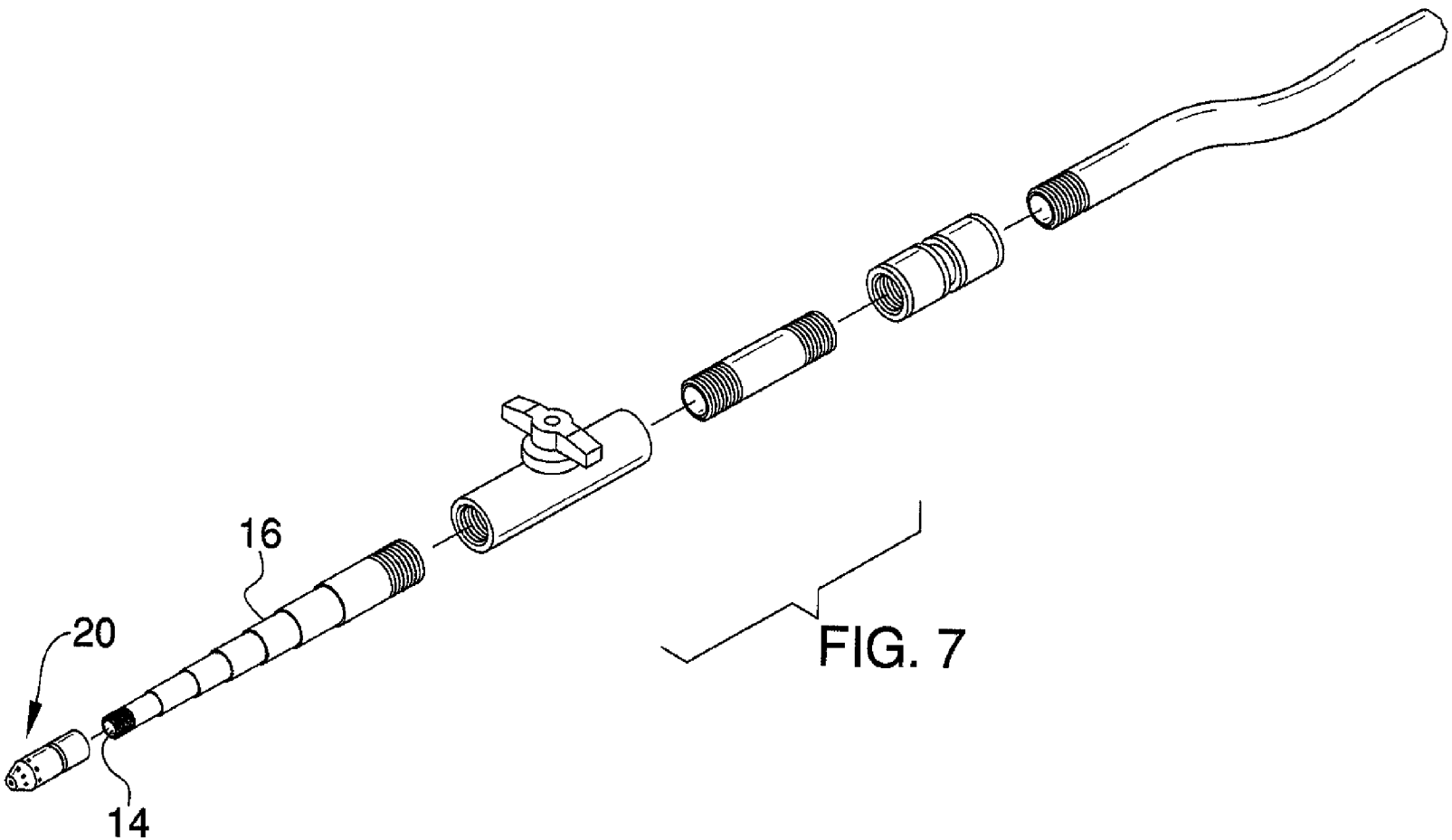
FIG. 7 is a perspective view of a second embodiment of the present invention.
Figure 8:
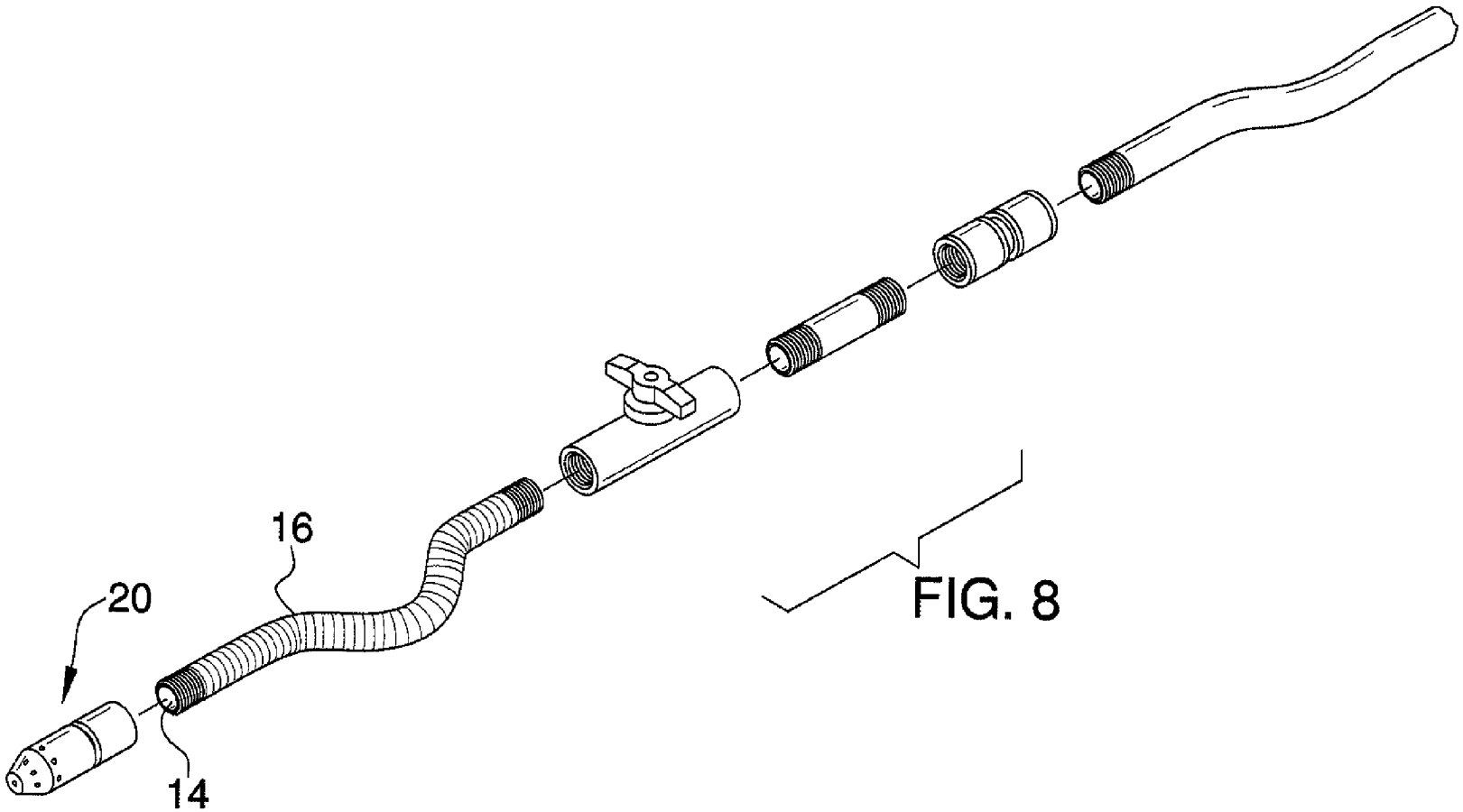
FIG. 8 is a perspective view of a third embodiment of the present invention.

As best illustrated in FIGS. 1 through 8, the recreational vehicle toilet tank cleaning assembly 10 generally comprises a tube 12 that has a terminal end 14. The tube 12 includes a plurality of sections 16 that are removably couplable to each other to alter a length of the tube 12. A valve 18 is mounted in one of the sections 16. The valve 18 selectively opens or closes the tube. The section 16 including the terminal end 14 is flexible in one embodiment shown in FIG. 8 or telescopic as shown in FIG. 7. In particular, the tube 12 may have length between 30 inches and 48 inches.

A nozzle 20 is removably coupled to the terminal end 14. The nozzle 20 has a first end 22, a second end 24 and a perimeter wall 26 extending between the first 22 and second 24 ends. The first end 22 is open and is threadably coupled to the terminal end 14 of the tube 12. The nozzle 20 has a plurality of apertures 27 therein. The apertures 27 include a primary aperture 28 that extends through the second end 24 and is aligned with a longitudinal axis of the nozzle 20. The plurality of apertures 27 includes a plurality of secondary apertures 30. The secondary apertures 30 are positioned in the perimeter wall 26 positioned nearer to the second end 24 than the first end 22 and are oriented perpendicular to the longitudinal axis. The plurality of apertures 27 includes a plurality of tertiary apertures 32 extending through the perimeter wall 26 and positioned between the second end 24 and the secondary apertures 30. The tertiary apertures 32 are each angled away from the first end 22. The perimeter wall 26 includes a tapered portion 34 tapering inward adjacent to the second end 24. The tapered portion 34 has the tertiary apertures 32 therein. The perimeter wall 26 has a break 36 therein and the nozzle 20 includes a first portion 38 rotatably coupled to a second portion 40. The second portion 40 includes the plurality of apertures 27.

A plurality of angled fins 42 is attached to an inner surface of the second portion 40. The fins 42 cause the second portion 40 to rotate with respect to the first portion 38 when a fluid flows through the tube 12 and outwardly of the nozzle 20. This causes the second portion 40 to spin and spray fluid in all directions within the receiving tank and may also be used for the tubing of the toilet system of the recreational vehicle.

In use, a distal end 44 of the tube 12 with respect to the terminal end 14 is fluidly couplable to a water source 46, with or without cleaning solution, and the nozzle 20 extended into the receptacle tank of a recreational vehicle's toilet system to eject water outwardly of the plurality of apertures 27 and clean the tank. The tube 12 may be extended throughout the tank to ensure thorough cleaning thereof. The distal end 44 may comprise any conventional male or female coupler used for fluidly coupling the tube 12 to the water source.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A recreational vehicle toilet tank cleaning assembly comprising:

a tube having a terminal end;

a nozzle being removably coupled to said terminal end, said nozzle having a first end, a second end and a perimeter wall extending between said first and second ends, said first end being open and being threadably coupled to said terminal end of said tube, said nozzle having a plurality of apertures therein, said apertures including a primary aperture extending through said second end and being aligned with a longitudinal axis of said nozzle, said perimeter wall having a break therein and said nozzle including a first portion rotatably coupled to a second portion, said second portion including said plurality of apertures;

said plurality of apertures including a plurality of secondary apertures positioned in said perimeter wall and positioned nearer to said second end than said first end and oriented perpendicular to said longitudinal axis;

said plurality of apertures including a plurality of tertiary apertures extending through said perimeter wall and positioned between said second end and said secondary apertures, said tertiary apertures being angled away from said first end and being angled toward said second end such that fluid sprayed from said tertiary apertures flows between fluid sprayed from said primary aperture and fluid sprayed by said secondary apertures;

each of said apertures is orientated to prevent water from spaying through said apertures and toward a plane that intersects said first end and is orientated perpendicular to said longitudinal axis; and wherein said tube is fluidly couplable to a water source and said nozzle placed in a recreational vehicle toilet receiving tank to eject water outwardly of said plurality of apertures and clean the tank.

2. The assembly according to claim 1, wherein said tube including a plurality of sections, said sections being removably couplable to each other to alter a length of said tube.

3. The assembly according to claim 2, further including a valve being mounted in one of said sections, said valve selectively opening or closing said tub.

4. The assembly according to claim 1, wherein said perimeter wall includes a tapered portion tapering inward adjacent to said second end, said tapered portion having said tertiary apertures therein.

5. The assembly according to claim 1, further including a plurality of angled fins being attached to an inner surface of said second portion, said fins causing said second portion to rotate with respect to said first portion when a fluid flows through said tube.

6. A recreational vehicle toilet tank cleaning assembly comprising:

a tube having a terminal end, said tube including a plurality of sections, said sections being removably couplable to each other to alter a length of said tube, a valve being mounted in one of said sections, said valve selectively opening or closing said tube;

a nozzle being removably coupled to said terminal end, said nozzle having a first end, a second end and a perimeter wall extending between said first and second ends, said first end being open and being threadably coupled to said terminal end of said tube, said nozzle having a plurality of apertures therein, said apertures including a primary aperture extending through said second end and being aligned with a longitudinal axis of said nozzle, said plurality of apertures including a plurality of secondary apertures positioned in said perimeter wall and positioned nearer to said second end than said first end and oriented perpendicular to said longitudinal axis, said plurality of apertures including a plurality of tertiary apertures extending through said perimeter wall and positioned between said second end and said secondary apertures, said tertiary apertures being angled away from said first end, said perimeter wall including a tapered portion tapering inward adjacent to said second end, said tapered portion having said tertiary apertures therein, said perimeter wall having a break therein and said nozzle including a first portion rotatably coupled to a second portion, said second portion including said plurality of apertures;

a plurality of angled fins being attached to an inner surface of said second portion, said fins causing said second portion to rotate with respect to said first portion when a fluid flows through said tube; and wherein said tube is fluidly couplable to a water source and said nozzle placed in a recreational vehicle toilet receiving tank to eject water outwardly of said plurality of apertures and clean the tank.

7. A recreational vehicle toilet tank cleaning assembly comprising:

a tube having a terminal end;

a nozzle being removably coupled to said terminal end, said nozzle having a first end, a second end and a perimeter wall extending between said first and second ends, said first end being open and being threadably coupled to said terminal end of said tube, said nozzle having a plurality of apertures therein, said apertures including a primary aperture extending through said second end and being aligned with a longitudinal axis of said nozzle, said perimeter wall having a break therein and said nozzle including a first portion rotatably coupled to a second portion, said second portion including said plurality of apertures;

a plurality of angled fins being attached to an inner surface of said second portion, said fins causing said second portion to rotate with respect to said first portion when a fluid flows through said tube; and wherein said tube is fluidly couplable to a water source and said nozzle placed in a recreational vehicle toilet receiving tank to eject water outwardly of said plurality of apertures and clean the tank.

8. The assembly according to claim 7, wherein said tube including a plurality of sections, said sections being removably couplable to each other to alter a length of said tube.

9. The assembly according to claim 8, further including a valve being mounted in one of said sections, said valve selectively opening or closing said tub.

10. The assembly according to claim 7, wherein said plurality of apertures includes a plurality of secondary apertures positioned in said perimeter wall and positioned nearer to said second end than said first end and oriented perpendicular to said longitudinal axis, said plurality of apertures including a plurality of tertiary apertures extending through said perimeter wall and positioned between said second end and said secondary apertures, said tertiary apertures being angled away from said first end.

11. The assembly according to claim 10, wherein said perimeter wall includes a tapered portion tapering inward adjacent to said second end, said tapered portion having said tertiary apertures therein.

* * * * *